US011499548B2

(12) United States Patent
Hinrichs et al.

(10) Patent No.: US 11,499,548 B2
(45) Date of Patent: Nov. 15, 2022

(54) GEROTOR PUMP AND METHOD FOR PRODUCING SAME

(71) Applicant: HANON SYSTEMS EFP DEUTSCHLAND GMBH, Bad Homburg v. d. Höhe (DE)

(72) Inventors: Jan Hinrichs, Friedrichsdorf (DE); Tilo Schäfer, Daubach (DE); Bernd Denfeld, Bad Homburg (DE)

(73) Assignee: HANON SYSTEMS EFP DEUTSCHLAND GMBH, Bad Homburg v. d. Höhe (DE)

( * ) Notice: Subject to any disclaimer, the term of this patent is extended or adjusted under 35 U.S.C. 154(b) by 210 days.

(21) Appl. No.: 16/768,992

(22) PCT Filed: Dec. 10, 2018

(86) PCT No.: PCT/EP2018/084164

§ 371 (c)(1),
(2) Date: Jun. 2, 2020

(87) PCT Pub. No.: WO2019/121102

PCT Pub. Date: Jun. 27, 2019

(65) Prior Publication Data

US 2021/0222692 A1 Jul. 22, 2021

(30) Foreign Application Priority Data

Dec. 22, 2017 (DE) ..... 10 2017 223 715.5

(51) Int. Cl.
*F04C 2/10* (2006.01)
*F04C 11/00* (2006.01)
*F04C 15/00* (2006.01)

(52) U.S. Cl.
CPC ..... *F04C 2/10* (2013.01); *F04C 2/102* (2013.01); *F04C 11/008* (2013.01);
(Continued)

(58) Field of Classification Search
CPC ..... F04C 2/10; F04C 2/102; F04C 11/008; F04C 15/008; F04C 2230/20;
(Continued)

(56) References Cited

U.S. PATENT DOCUMENTS 4,553,442 A * 11/1985 Mazzorana ..... F02N 15/06 310/43
4,898,518 A * 2/1990 Hubbard ..... F04D 29/126 417/360

(Continued)

FOREIGN PATENT DOCUMENTS

DE 10248933 C1 12/2003
DE 102009028154 A1 2/2011

(Continued)

OTHER PUBLICATIONS

Office Action regarding Japanese Patent Application No. 2020-554376 (with English translation), dated Apr. 6, 2021.

(Continued)

*Primary Examiner* — Charles G Freay
(74) *Attorney, Agent, or Firm* — Harness, Dickey & Pierce, P.L.C.

(57) ABSTRACT

Gerotor pump comprising an inner gerotor and an outer gerotor and an electric motor in a pump housing, and the outer gerotor is formed integrally with the rotor of the electric motor, wherein magnets are integrated into the outer gerotor, and the rotor is rotatably mounted on a shaft that is fixed on one side to a housing or a housing base of the pump housing.

12 Claims, 3 Drawing Sheets

(52) U.S. Cl.
CPC ..... *F04C 15/008* (2013.01); *F04C 2230/20* (2013.01); *F04C 2230/60* (2013.01); *F04C 2240/20* (2013.01); *F04C 2240/30* (2013.01); *F04C 2240/40* (2013.01); *F04C 2240/50* (2013.01); *F04C 2240/51* (2013.01); *F04C 2240/60* (2013.01)

(58) Field of Classification Search
CPC ..... F04C 2230/60; F04C 2240/20; F04C 2240/30; F04C 2240/40; F04C 2240/50; F04C 2240/51; F04C 2240/60; H02K 5/00; H02K 5/02; H02K 5/04; H02K 5/08
See application file for complete search history.

(56) References Cited

U.S. PATENT DOCUMENTS

| | | | | |
|---|---|---|---|---|
| 8,974,207 | B2 | 3/2015 | Bodzak | |
| 2006/0140810 | A1* | 6/2006 | Kameya | F04C 15/0034 418/61.3 |
| 2007/0231176 | A1 | 10/2007 | Asai et al. | |
| 2009/0175751 | A1* | 7/2009 | Nakayoshi | F04C 2/086 310/58 |
| 2012/0148426 | A1 | 6/2012 | Bodzak | |
| 2018/0128268 | A1 | 5/2018 | Bornemann et al. | |

FOREIGN PATENT DOCUMENTS

| | | | |
|---|---|---|---|
| DE | 102010041237 | A1 | 3/2012 |
| DE | 102011005304 | A1 | 3/2012 |
| DE | 102014226002 | A1 | 6/2016 |
| DE | 102015010728 | A1 | 2/2017 |
| JP | S6081489 | A | 5/1985 |
| JP | 2001193667 | A | 7/2001 |
| JP | 2007-146833 | A | 6/2007 |
| JP | 2009-156081 | A | 7/2009 |
| JP | 2011-58441 | A | 3/2011 |
| JP | 2012-193702 | A | 10/2012 |
| JP | 2013500430 | A | 1/2013 |
| JP | 2013-201895 | A | 10/2013 |
| JP | 201620216 | A | 2/2016 |
| JP | 2017127183 | A | 7/2017 |
| WO | 2016174164 | A1 | 11/2016 |
| WO | WO 2017/089298 | * | 6/2017 |

OTHER PUBLICATIONS

Office Action regarding Japanese Patent Application No. 2020-554376, dated Sep. 6, 2022.

* cited by examiner

GEROTOR PUMP AND METHOD FOR PRODUCING SAME

CROSS-REFERENCE TO RELATED APPLICATIONS

This application is a 371 U.S. National Phase of International Application No. PCT/EP2018/084164, filed Dec. 10, 2018, which claims the benefit of German Patent Application No. 10 2017 223 715.5, filed Dec. 22, 2017. The entire disclosures of each of the above applications are incorporated herein by reference.

FIELD

The disclosure relates to a gerotor pump having an inner gerotor and an outer gerotor and an electric motor in a pump housing, wherein the outer gerotor is formed integrally with the rotor of the electric motor, wherein magnets are integrated into the outer gerotor.

Furthermore, the disclosure relates to a method for producing a gerotor pump.

BACKGROUND

This section provides background information related to the present disclosure which is not necessarily prior art.

Positive displacement pumps and in particular gerotor pumps are usually driven by a shaft which is set into rotation by an electrical or mechanical drive.

These pumps are used for many technical applications for the transport of a fluid. For example, fuel pumps are used to transport fuel to an internal combustion engine. Gerotor pumps are also installed in hydraulic circuits for clutch actuation or are used as pumps in the cooling circuit. The electric motor of the pump comprises a stator as well as a rotor with permanent magnets.

The electric motor and the pump are thereby arranged within a housing. Thus, a space is created in the housing, in particular a work space, in which the fluid to be transported is located.

This requires a rotating shaft which should preferably be mounted on both sides due to its long extension. The respective bearings must thereby be positioned to each other in a suitable manner. This requires small tolerances on all housing components involved, which becomes increasingly difficult for the housing components when changing the material from metal to plastic.

When used in a gear, pumps are installed as a closed unit, with the drive being made by a shaft-hub connection.

Known from DE 102011005304 A1 is an impeller having conveying elements, by which a rotational movement is performed about a rotational axis. The impeller with the conveying elements and the electric motor are arranged within a housing, and the pump is integrated into the electric motor or vise versa in that the rotor is formed by the impeller, wherein the stator is at least partially or completely covered by a sealing sleeve. The impeller rotates about a shaft end formed by the housing.

WO 2016174164 A1 shows a gerotor pump driven by an electric motor which is coupled to a pump rotor of the fluid pump, wherein the electric motor is an axial-flux electric motor, the electric-motor rotor of which is also the pump rotor, and the pump rotor and the electric-motor rotor are accommodated in a common housing, in which the pump rotor and the electric-motor rotor rotate while integrated as a combination rotor in a disk shape, wherein the common housing has a fluid inlet and a fluid outlet to the combination rotor.

Known from US 2007/0 231 176 A1 is a gerotor pump in a housing, wherein the inner gerotor is assembled with the rotor of an electrical machine.

SUMMARY

This section provides a general summary of the disclosure, and is not a comprehensive disclosure of its full scope or all of its features.

It is the object of the disclosure to form a gerotor pump that is easy to construct.

The object is solved by means of a gerotor pump having an inner gerotor and an outer gerotor and an electric motor in a pump housing, wherein the outer gerotor is integrally formed with the rotor of the electric motor, wherein magnets are integrated into the outer gerotor, and the rotor is rotatably mounted on a shaft that is fixed to a housing or a housing base of the pump housing.

With the design of the pump according to the disclosure, the drive takes place, contrary to what is usually the case, directly from the rotor of the electric motor to the outer gerotor of the pump so that the inner gerotor of the pump only runs/travels therewith, and the shaft only has the task of centering and supporting components. It is now sufficient for this reduced range of duties of the shaft to fixedly embed the shaft on one side in one of the housing components and to expose it on the opposite side.

The components of the pump can be assembled from the shaft end of the shaft, i.e. the open side of the shaft, and then fixed with a bearing ring which is pressed at a specific height to adjust the axial gap.

In one embodiment, the gerotor pump according to the disclosure is connected to the housing of an assembly such as a clutch or a gear or a driving machine, and thus the housing of the assembly constitutes the housing base of the gerotor pump, which supports at least the shaft.

The attachment of the shaft to a metallic housing is simple and can be made by technical means.

In an alternative embodiment, the housing base is made of a plastic material. A very rigid and tension-resistant connection between shaft and the supporting housing part is required, and therefore stiffener elements such as insert plates or similar must be used when a housing base is made of a plastic material.

Advantageously, the pump housing has a bell-shaped housing lid that includes at least one stator but can also comprise electronic components, printed circuit boards and terminal connections.

It is particularly advantageous if the stator with windings is molded in a plastic material and forms the housing lid. Thus, the stator is protected, and the gerotor pump does not have to be sealed. The coated stator forms a closed housing open on one side which seals inwards and outwards. This allows an operation in the fluid environment of the assembly.

The pump is designed in such a way that the bell-shaped housing lid has an inner diameter corresponding to the outer diameter of the rotor and an air gap.

Depending on the embodiment, the bell-shaped housing lid is attached to the housing or the housing base of the pump housing by means of seals.

The bell-shaped housing lid is advantageously attachable by means of a bayonet connection.

The object is also solved by a method for producing a gerotor pump, having the following steps:

attaching a shaft on one side to a housing or to a housing base of a pump housing, placing an inner gerotor on the shaft, placing an outer gerotor as a rotor on the shaft, pressing or clamping the bearing ring with the shaft, placing over a bell-shaped housing lid, connecting the housing lid to the housing or the housing base of the pump housing.

Advantageously, the shaft of the pump is fixedly embedded in one of the housing components, wherein the components of the pump are mounted from the open side, and the axial gap is adjusted by a controlled pressing operation. When pressing the axial bearing onto the shaft, the axial clearance can also be adjusted.

It is an advantage that the housing components are made of a plastic material and are connected by means of bayonet connections. Axial forces resulting from the pressure build-up of the pump are not transmitted via the housing, but via the shaft and the shaft attachment. This reduces the risk of flow in plastic housing parts, and the requirements on seals and assembly elements are reduced.

In an advantageous embodiment, the housing lid comprises at least one stator which is completely molded in or coated with a plastic material, and thus the pump can also operate without any problems in the medium of the assembly to which it is attached.

DRAWINGS

The drawings described herein are for illustrative purposes only of selected embodiments and not all possible implementations, and are not intended to limit the scope of the present disclosure.

The disclosure is described below by way of examples with reference to the accompanying drawings.

Corresponding reference numerals indicate corresponding parts throughout the several views of the drawings.

DETAILED DESCRIPTION

Example embodiments will now be described more fully with reference to the accompanying drawings.

Figure 1:
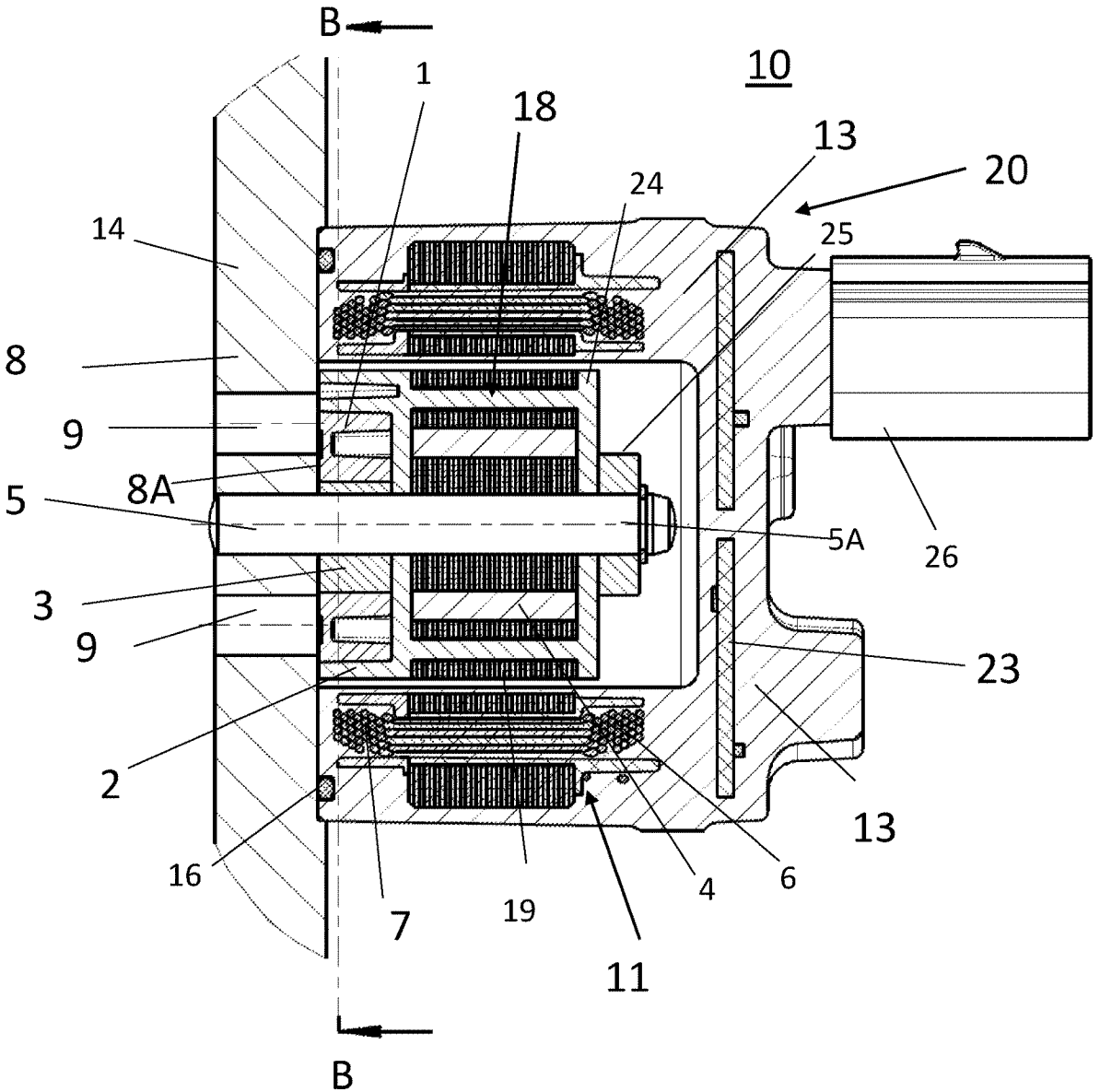
FIG. 1 shows a schematic illustration of a first exemplary embodiment.

A gerotor pump 10 is arranged in a pump housing 20 which essentially consists of a housing lid 13 and a housing base 14. In the embodiment of FIG. 1, the housing base 14 is formed by a flat area of a housing 8 of an assembly in a vehicle. Such an assembly can be a drive, an internal combustion engine or an electric machine or a gear or a clutch, etc. In addition to the shaft mounting, the assembly also includes the suction and pressure kidney of the pump.

The area of the housing 8 of the assembly has to be prepared for the attachment of the gerotor pump, thus must have a flat, circular surface 8A and, potentially, comprise grooves for an O-ring 16.

Openings 9 are provided in the housing 8 for the inflow and outflow of the pump fluid. A shaft 5 is connected to the housing 8, which is realized, for example, by pressing a shaft 5 made of metal into the metallic housing 5.

After the housing of the assembly with the shaft 5 is prepared, the further components of the pump are slid onto the shaft. First of all, an eccentric 3 is slipped over, which has to be non-rotatably connected to the shaft 5 of the housing 8. An inner gerotor 1, i.e. a gear having a first number of teeth 21, is placed onto the eccentric 3. The inner gerotor 1 is eccentrically constructed in relation to the shaft 5.

The inner gerotor 1 is surrounded by the outer gerotor 2 with a second number of teeth 21, wherein the second number of teeth is one greater than the first number of teeth of the inner gerotor 1.

The outer gerotor 2 is thereby integrated in one component with a rotor 18 of an electric motor 11, wherein the teeth 21 of the outer gerotor 2 are formed as an edge structure along a cylindrical circumference. The cylindrical outer contour of the rotor 18 also includes magnets 4 installed in laminated cores 19. The components of the rotor 18 are molded in a plastic material so as to form a one-piece component that is easy to mount.

The component consisting of outer gerotor 2 equal to rotor 18 is also placed onto the shaft 5.

With the design of the pump according to the disclosure, the drive takes place, different from usual, directly from the rotor 18 of the electric motor 11 to the outer gerotor 2 of the pump so that the inner gerotor 1 of the pump only runs/follows therewith, and the shaft 5 only has the task of centering and supporting components.

It is sufficient for this reduced range of duties of the shaft 5 to fixedly embed the shaft end 5A on one side in one of the housing components and to expose it on the opposite side. The components of the pump can be assembled from this open side of the shaft, and then fixed with an axial bearing g 25 which is pressed at a specific height between gerotors 1, 2 and the flat surface 8A of the housing to adjust the axial gap.

The pump housing 20 has a bell-shaped housing lid 13 that has a cylindrical opening. The dimension of the cylindrical opening in the housing lid 13 is determined by the outer diameter of the outer gerotor 2 plus an air gap. The stator 6 of the electric motor 11 is installed in the housing lid or in the wall of the housing lid.

The stator 6 with its windings 7 is also molded in a plastic material so as to form a housing lid with integrated stator components. The electric control on the circuit board 23 as well as supply lines and terminals and a connector 26 are also produced or connected in the process of molding or coating with a plastic material.

The bell-shaped housing lid is slid onto the rotor 18 and sits flush, but without pretension, on the planar surface 8A of the housing 8. The housing lid 13 only needs to be connected to the housing 8, and the gerotor pump is completed.

In that the stator and all of the electric components are molded, the pump and the electric motor can also be operated in the medium of the assembly, to which the gerotor pump is attached.

Figure 2:
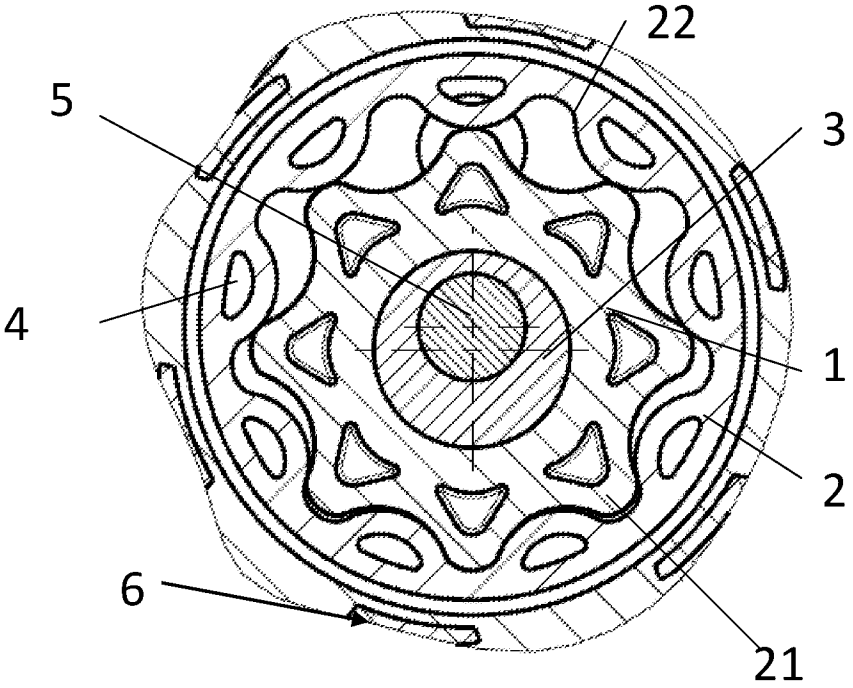
FIG. 2 shows a section along the plane B-B of FIG. 1.

FIG. 2 shows in cross section the outer gerotor 2 with its contour 22, in which the inner gerotor 1 rotates eccentrically with its teeth 21. The stator 6 is only indicated. The outer gerotor 2, which represents the rotor 18, rotates in the magnetic field of the stator 6.

Figure 3:
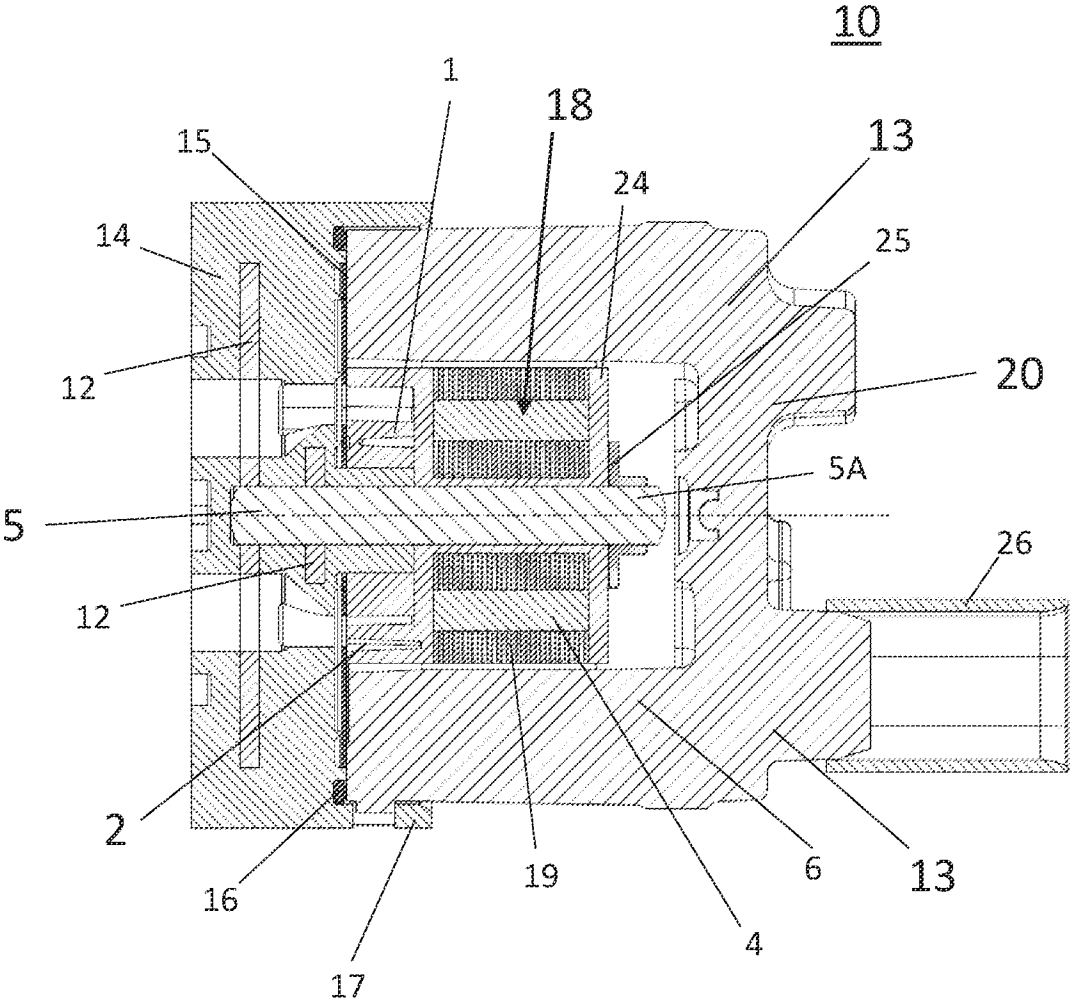
FIG. 3 shows a second embodiment.

FIG. 3 shows an alternative embodiment for a gerotor pump as an independent pump in a pump housing made of a plastic material, which essentially consists of a housing base 14 and a housing lid 13.

The set up of the pump and of the electric motor 11 correspond to the set up according to FIG. 1, wherein the illustration of the stator components was dispensed with.

Since in this embodiment the shaft 5 is supported by a plastic housing base, stiffeners 12 are provided which as metallic inserts allow a force-fitting connection between housing base and shaft 5.

The connection of the housing lid 13 to the housing base 14 is realized by a bayonet connection 17.

A membrane 15 between the housing components is used to compensate the gap between the gerotors 1 and 2 as well as the housing base 14.

Moreover, the membrane 15 is an advantageous solution if it is configured as a metal sheet since in that case it is a low-wear sliding element for the gerotors.

The method for producing a gerotor pump according to the disclosure provides the following steps:

attaching a shaft 5 on one side to a housing 8 or a housing base 14 of a pump housing 20, placing an inner gerotor 1 on the shaft 5, placing an outer gerotor 2 on the shaft 5 as a rotor 18, pressing or clamping the bearing ring with the shaft, placing over a bell-shaped housing lid 13 over stator 6, connecting the housing lid to the housing 8 or the housing base 14 of the pump housing 20.

Especially the last step, i.e. the connecting, can be simplified if the housing components are made of a plastic material and are connected to each other by means of bayonet connections 17. However, other connections are also possible, for instance snap connections or also bolt connections.

For the assembly of the pump, it is particularly advantageous that the housing lid includes at least one stator which is completely molded in or coated with a plastic material. As a result, the housing lid is molded with all of the electronic components and is to be mounted as a single component.

The foregoing description of the embodiments has been provided for purposes of illustration and description. It is not intended to be exhaustive or to limit the disclosure. Individual elements or features of a particular embodiment are generally not limited to that particular embodiment, but, where applicable, are inter-changeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A gerotor pump comprising:

a housing;

an inner gerotor;

an outer gerotor;

an electric motor including a motor rotor, wherein each of the inner gerotor, the outer gerotor and the electric motor are positioned in the housing, wherein the outer gerotor is integrally formed with the motor rotor, wherein magnets are incorporated into the outer gerotor; and a shaft that is fixed on one side to the housing, wherein the motor rotor is directly rotatably mounted to an end of the shaft by a bearing.

2. The gerotor pump according to claim 1, wherein the housing is a housing of a clutch or of a gear or of a driving machine.

3. The gerotor pump according to claim 1, wherein the housing is metallic.

4. The gerotor pump according to claim 1, wherein the housing includes a plastic component and has stiffeners.

5. The gerotor pump according to claim 1, wherein the housing comprises a bell-shaped housing lid which comprises at least one stator of the electric motor.

6. The gerotor pump according to claim 5, wherein the stator includes windings molded in a plastic material that forms the housing lid.

7. The gerotor pump according to claim 5, wherein the bell-shaped housing lid has an inner diameter corresponding to an outer diameter of the motor rotor plus an air gap.

8. The gerotor pump according to claim 1, wherein the bell-shaped housing lid is mounted to the housing by seals.

9. The gerotor pump according to claim 1, wherein the bell-shaped housing lid is attached by a bayonet connection.

10. A method for producing a gerotor pump according to claim 1, comprising the steps of:

attaching the shaft on one side to the housing wherein the housing includes a bell-shaped housing lid and a housing base, placing the inner gerotor on the shaft, placing the outer gerotor on the shaft as the motor rotor, pressing or clamping the bearing with the shaft, placing the bell-shaped housing lid over the housing base, and connecting the housing lid to the housing base.

11. The method according to claim 10, wherein the housing lid and the housing base are made of a plastic material and are connected by bayonet connections.

12. The method according to claim 10 wherein the housing lid contains at least one stator that is completely molded in or coated with a plastic material.

* * * * *